US006572166B2

(12) United States Patent
Cash

(10) Patent No.: US 6,572,166 B2
(45) Date of Patent: Jun. 3, 2003

(54) BALL RETRIEVAL DEVICE

(76) Inventor: Cecil E. Cash, 4861 Al Hwy. 183, Lawley, AL (US) 36793

( * ) Notice: Subject to any disclaimer, the term of this patent is extended or adjusted under 35 U.S.C. 154(b) by 0 days.

(21) Appl. No.: 09/798,863

(22) Filed: Feb. 28, 2001

(65) Prior Publication Data

US 2002/0117870 A1 Aug. 29, 2002

(51) Int. Cl.[7] ..... A63B 47/02
(52) U.S. Cl. ..... 294/19.2
(58) Field of Search ..... 294/19.1, 19.2, 294/19.3, 99.1, 99.2; 56/328.1, 332; 221/307, 199, 309; 224/919; 81/53.11; 473/460, 464; D21/721, 791

(56) References Cited

U.S. PATENT DOCUMENTS

| | | | | | |
|---|---|---|---|---|---|
| 713,672 | A | | 11/1902 | Oliver | 294/19.2 |
| 771,886 | A | * | 10/1904 | Smith | 294/19.2 |
| 1,937,828 | A | | 12/1933 | Macdonald | 294/19.2 |
| 2,154,989 | A | * | 4/1939 | Moore | 294/19.2 |
| 2,233,212 | A | * | 2/1941 | Jensen | 81/53.11 |
| 2,657,056 | A | * | 10/1953 | Sorteberg | 294/19.2 |
| 2,760,807 | A | | 8/1956 | Watson | 294/19.2 |
| 2,768,775 | A | * | 10/1956 | Houser | 221/309 |
| 3,058,767 | A | | 10/1962 | Baker | 294/19.2 |
| 3,929,364 | A | * | 12/1975 | Haley | 294/19.1 |
| 4,058,336 | A | | 11/1977 | Parkinson | 294/19.2 |
| 4,106,678 | A | * | 8/1978 | Thomas | 294/19.1 |
| 4,334,707 | A | * | 6/1982 | Phillips | 294/19.2 |
| 4,519,643 | A | * | 5/1985 | Harris | 294/19.1 |
| 4,663,996 | A | | 5/1987 | Grudgfield et al. | 294/99.1 |
| 4,678,108 | A | | 7/1987 | Inman | 224/274 |
| 4,714,250 | A | * | 12/1987 | Henthorn | 294/19.2 |
| 4,964,665 | A | | 10/1990 | Crow | 294/19.2 |
| 5,060,996 | A | | 10/1991 | Garnes | 294/19.2 |
| 5,188,410 | A | | 2/1993 | Summers | 294/19.2 |
| 5,190,288 | A | | 3/1993 | Rogers | 294/19.2 |
| 5,190,331 | A | * | 3/1993 | Corbin | 294/19.1 |
| 5,299,846 | A | | 4/1994 | Rush | 294/19.2 |
| D350,579 | S | | 9/1994 | Lee | D21/721 |
| 5,466,027 | A | | 11/1995 | Hockey | 294/19.2 |
| 5,505,510 | A | | 4/1996 | Duncan | 294/19.2 |
| 5,651,571 | A | * | 7/1997 | Diveto | 294/19.2 |
| 5,755,632 | A | | 5/1998 | Eddy | 294/19.2 |
| D402,729 | S | | 12/1998 | Degenhardt | D21/791 |
| 5,908,214 | A | * | 6/1999 | Dinardo | 294/19.2 |
| 6,120,387 | A | | 9/2000 | Bobst | 294/19.2 |

FOREIGN PATENT DOCUMENTS

| | | | | |
|---|---|---|---|---|
| DE | 443501 | * | 3/1936 | 294/19.2 |
| GB | 0023274 | * | 3/1902 | 294/19.2 |
| IT | 501523 | * | 7/1956 | 294/19.2 |
| IT | 509811 | * | 11/1956 | 294/19.2 |

* cited by examiner

*Primary Examiner*—Dean J. Kramer
*Assistant Examiner*—Paul T. Chin
(74) *Attorney, Agent, or Firm*—Bradley Arant Rose & White, LLP

(57) ABSTRACT

A device for retrieving balls, such as golf balls, is disclosed. The device comprises an elongate shaft attached to a hollow cylindrical head of a resilient material, such as PVC. The head has an open end, the diameter of which allows it to accept the ball and hold it. The head has at least one notch extending from the edge of the forward end towards the rear of the head, and a pin affixed diametrically through walls of the head forward of the terminus of the notch. In a preferred embodiment, there are two notches in the forward end of the head diametrically opposed from one another and the pin is offset approximately ninety degrees from the notches. With this device, a golf ball lying on the ground, partially buried in the ground, underwater, obscured in brush, leaves, or tall grass, can be retrieved from nearly any angle.

10 Claims, 4 Drawing Sheets

BALL RETRIEVAL DEVICE

BACKGROUND

The present invention relates to ball retrieval, in particular golf balls. Golfers frequently hit their golf balls in unintended directions, resulting in their landing in lakes, in deep brush or briars, mud or sand. The golfer may only be able to access the ball from a relatively long distance, for example eight to ten feet, and then his angle of access may be rather oblique with respect to the surface on which the ball rests. On occasion a golfer may run over a ball with his golf cart, or step on it, and nearly bury it in the turf. A variety of devices have been invented to retrieve golf balls. However, none are capable of retrieving a ball under all of the conditions described above. What is needed, therefore, is a ball retrieval device that will retrieve a ball lying in water, mud, sand, partially buried in dirt, brush or briars, and from a relatively long distance, and from variety of angles of access.

SUMMARY OF THE INVENTION

A device for retrieving balls, such as golf balls, is disclosed. The device comprises an elongate shaft attached to a hollow cylindrical head of a resilient material, such as PVC. The head has an open end, the diameter of which allows it to accept the ball and hold it. The head has at least one notch in the cylindrical wall extending from the edge of the forward end towards the rear of the head, and a pin affixed diametrically through walls of the head forward of the terminus of the notch. In a preferred embodiment, there are two notches in the forward end of the head diametrically opposed from one another and the pin is offset uniformly from each of the notches. With this device, a golfball lying on the ground, partially buried in the ground, underwater, obscured in brush, leaves, or tall grass, can be retrieved from nearly any angle.

DESCRIPTION OF THE DRAWINGS

These and other features, aspects, structures, advantages, and functions are shown or inherent in, and will become better understood with regard to, the following description and accompanied drawings where.

DETAILED DESCRIPTION OF THE PREFERRED EMBODIMENT

Figure 1:
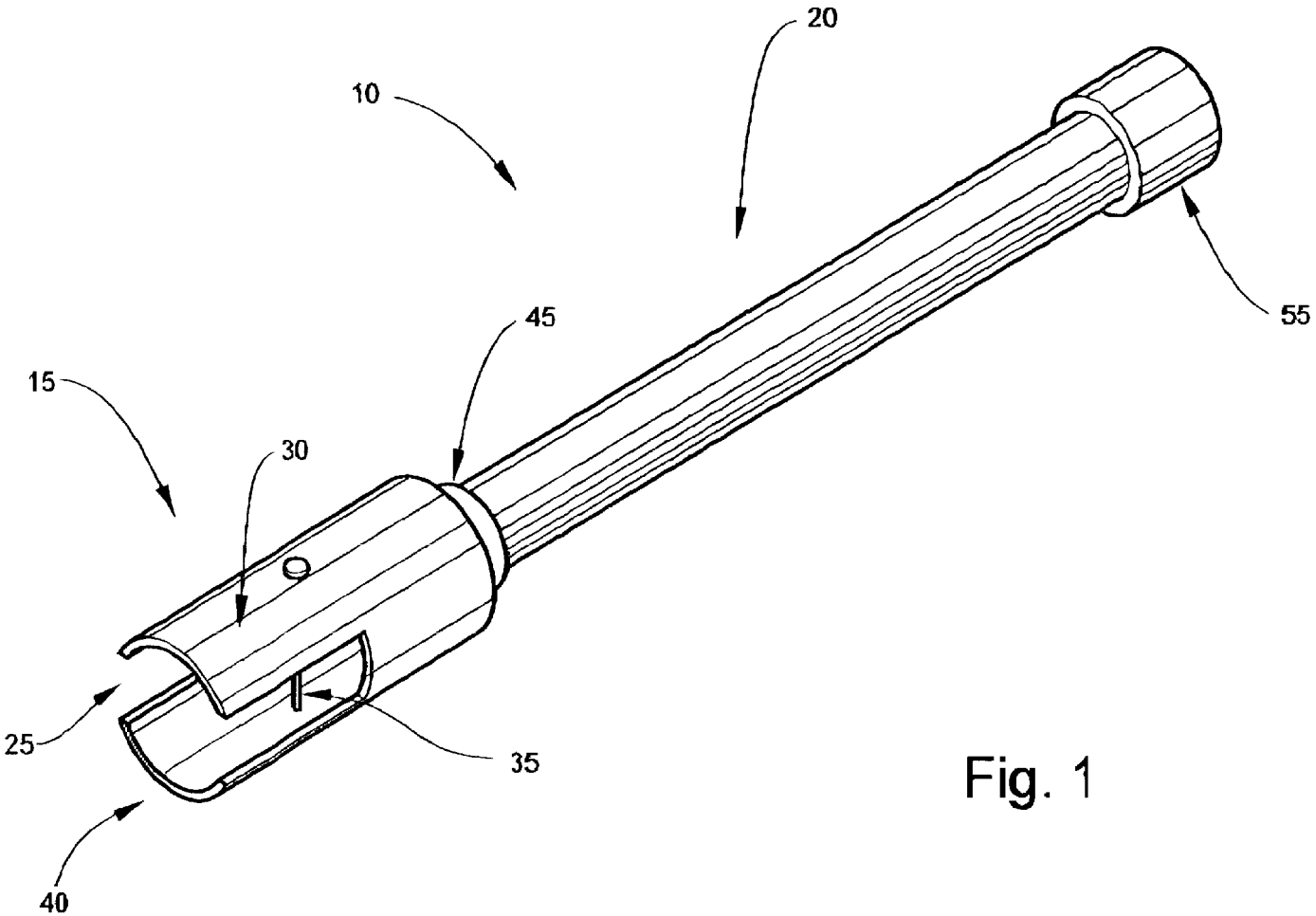
FIG. 1 is a perspective view of a preferred embodiment of the present invention.

As shown in FIG. 1, the ball retrieval device 10 of the present invention is comprised of a head 15 and an elongate shaft 20. The head 15 is generally cylindrically shaped, with an inner diameter of approximately the same or slightly smaller diameter of the particular ball which is desired to be retrieved. The forward end of the head is open and has at least one notch 25 in it. The head 15 also has a pin 35 attached and extending diametrically through the walls of the head, forward of the base or terminus of the notch 25.

In a preferred embodiment, the head 15 has two notches 25, generally opposite one another, and the pin 35 is generally uniformly offset from each of the notches. In this configuration, two arcuate extensions 30 are formed. These extensions 30 expand radially slightly as the head 15 is pressed over a ball, as described below, and then hold the ball in place. The notches 25 may be of any shape which will allow this function, such as rectangular, rounded, triangular, or other polygonal shape. The pin 35 limits the radial flexibility of the extensions 30 and acts as a ball stop. The notch or notches 25 allow easy access to the ball for removal. The pin 35 may be made of any resilient material, such as a durable plastic or polymer. It may also be made of brass, copper, aluminum, stainless steel, or other suitable material. The pin may be adjustable in length, in order to adjust the tension that the pin applies to the extensions 40. An adjustable pin may be made of two mating threaded sections, whereby the length of the pin may be varied by turning one section relative to the other.

Figure 5:
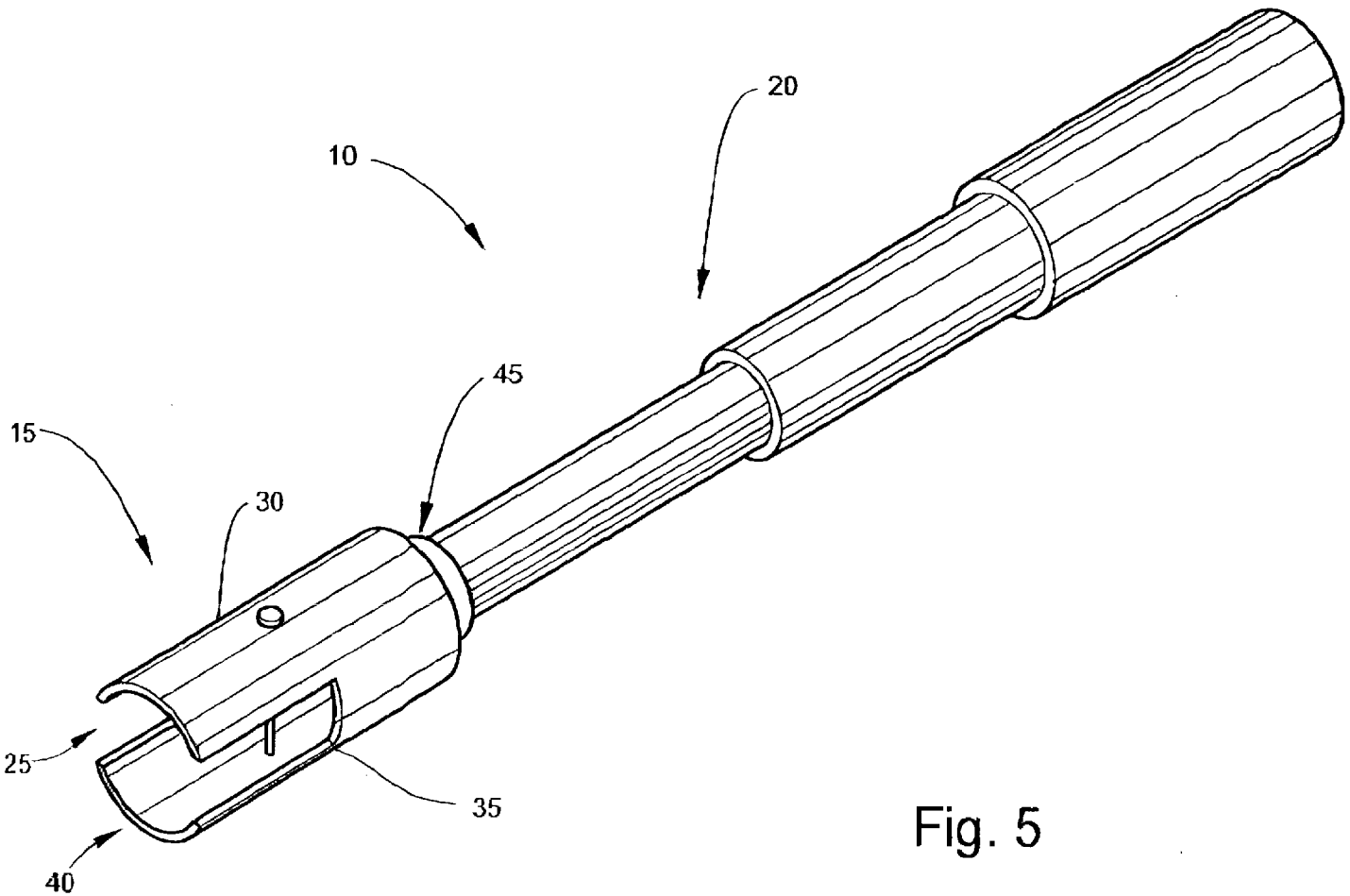
FIG. 5 is a perspective view of another embodiment of the present invention with a telescoping handle.

The shaft 20 is usually several feet long to provide the device with some reach and to keep the user from having to bend over to pick up a ball. The shaft 20 may be made of telescoping sections FIG 5., which may be extended to lengths of ten or fifteen feet or more, or retracted to a shorter length of two or three feet for storage. Such dimensions are illustrative only, and it should be understood that the shaft can vary from a short fixed length to a much longer variable length achieved by using telescoping sections. The shaft 20 also may be equipped with a handle near the end opposite the head 15.

Figure 2:
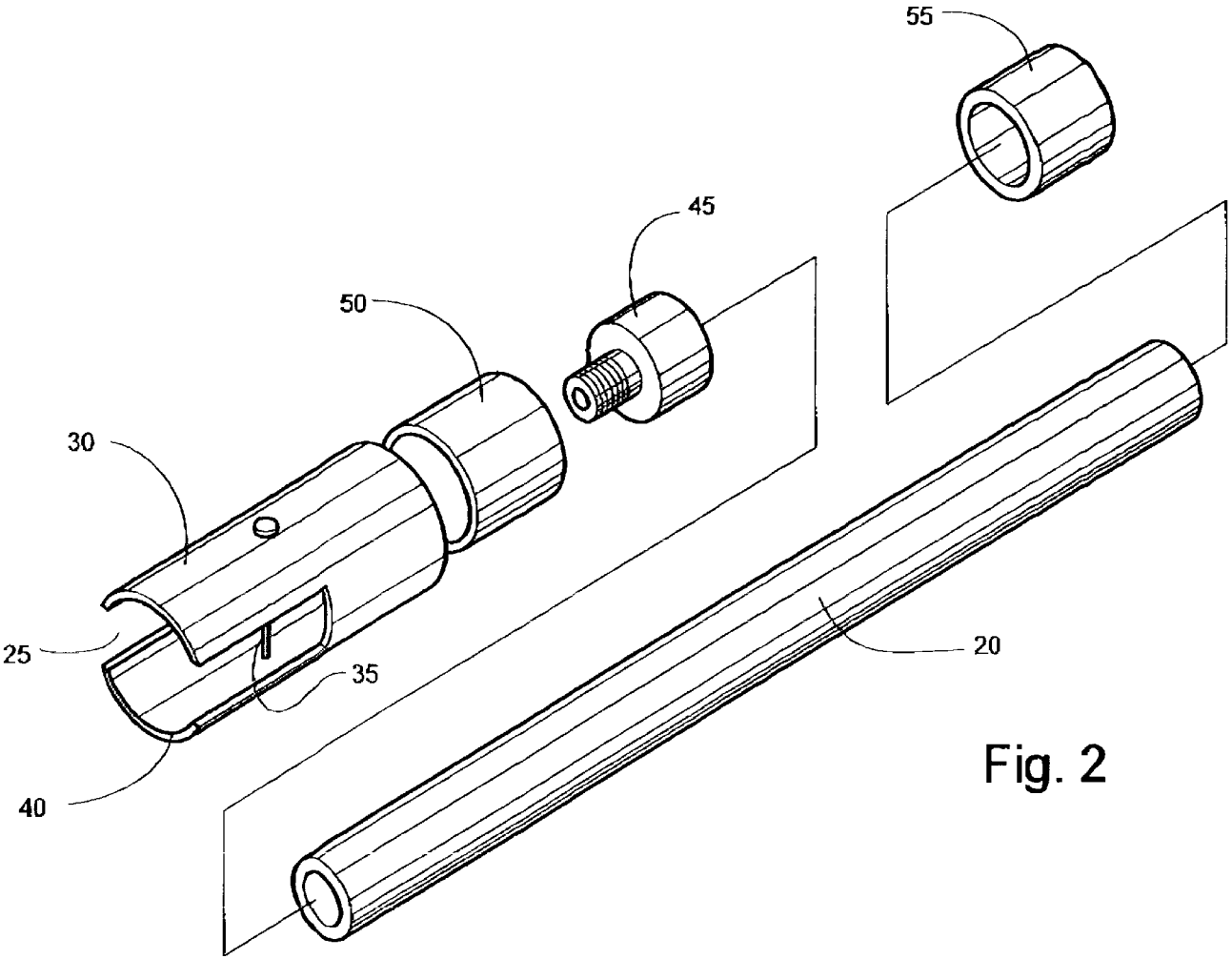
FIG. 2 is an exploded view of the embodiment of FIG. 1.
Figure 3:
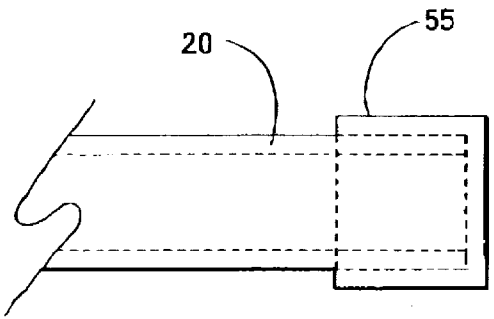
FIG. 3 is a side view of the embodiment of FIG. 1.
Figure 4:
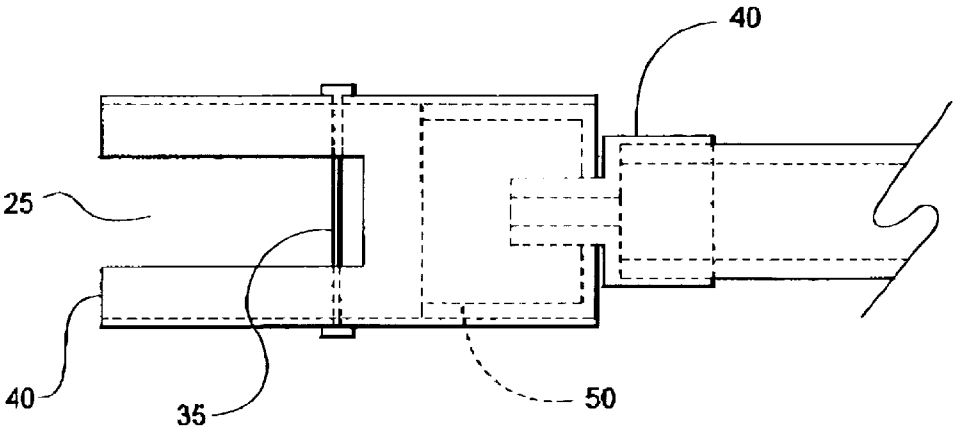
FIG. 4 is an end view of the embodiment of FIG. 1.
Figure 4:
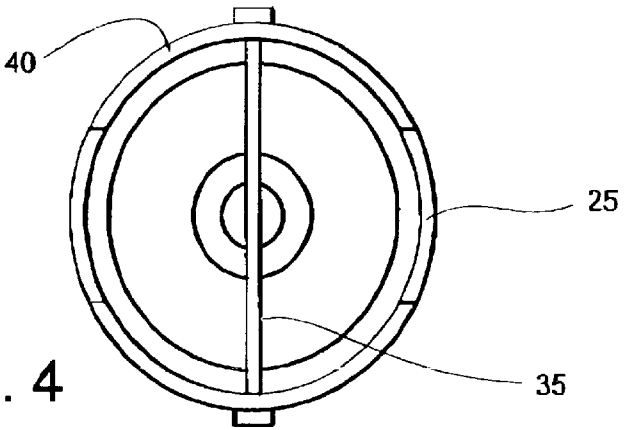

The entire device 10 (with the exception of the pin 35) may be made of readily available PVC materials, making it very inexpensive to manufacture. One possible construction is shown in FIGS. 2 and 3. A sleeve 50 is inserted into the head 15. The sleeve 50 has a female threaded receptacle, which is aligned with an opening in the end of the head adjacent the shaft. An adapter 45 having a male threaded barrel mates with the receptacle in the sleeve 50. At one end, the shaft 20 is affixed to adapter 45, and the other end of the shaft may be capped by end cap 55. These components may be assembled and secured using PVC cement. Of course, this is only one possible construction of the invention, and other materials and means of affixing a head to a shaft would be well known to those skilled in the art. The components could be made of wood, fiberglass, aluminum, PVC, or another polymer. Through the remainder of this description, the device will be discussed in the context of retrieving golf balls. However, it should be understood that the device can be adapted to pick up any sort of spherical object, such as baseballs or tennis balls.

Representative dimensions of the device, as adapted to retrieve golf balls, are as follows. The diameter of a standard golf ball is 1.68". To retrieve such a ball, the head 15 is made of PVC pipe with an outside diameter of 1¾", with an inside diameter of about 1⅝" (1.625"), and a length of about 4". The notches 25 are ⅞" wide and 2" long. The pin 35 is placed 1⅞" back from the front edge 40 of the head 15. The shaft may be made of ½" PVC pipe of any desired length. Note that apart from the inside diameter of the head 15, which is set according to the size of the golf ball and the radial flexibility of the extensions 30, the other dimensions may be varied to the suit the preferences of a particular individual or a particular set of conditions.

The device is used as follows. A golfer grasps the shaft 20, on the handle if provided, and positions the open head end over the desired golfball. The golfer then presses the head over the ball, and the ball is retained by the frictional force between it and the extensions 30. The device will usually pick up a ball from a variety of oblique angles. That is, the golfer need not be standing immediately over a ball to pick it up. As long as there is some minimal level of resistance to the ball's rolling, the device will retrieve the ball. In addition, the open ended design, having rather narrow edges 40, penetrates sand, mud, and dirt. The edges 40 of the head may be beveled to facilitate pushing through turf and soil. As the head is pressed over the ball, sand, mud, brush, and similar obstructions can pass through the notches 25. As a result, the device is useful for retrieving hard-to-reach balls in lakes, briars or brush, and balls in a "fried-egg" lie (where the ball is partially buried and only a portion of the ball is visible above the surrounding dirt or sand), as well as balls sitting on a green, fairway, or in the rough.

Upon reading the foregoing disclosure, minor variations and equivalent would be apparent to those skilled in the art. Therefore, the present invention should be defined with reference to the appended claims and their equivalents, and the spirit and scope of the claims should not be limited to the description of the preferred embodiments contained herein.

What is claimed is:

1. A ball retrieval device comprising:

an elongate shaft having a first end and a second end a hollow cylindrical head of a resilient material having an open forward end for retrieval and a rearward end, the rearward end of the head attached to said second end of the shaft, the head comprising:

at least one notch in the forward end, the at least one notch extending rearward from the edge of the forward end; and a pin affixed diametrically through walls of the head forward of the terminus of the notch, said pin limiting radially outward movement of said walls.

2. The device of claim 1 wherein there are two notches in the forward end of the head diametrically opposed from one another and the pin is approximately uniformly offset from the notches.

3. The device of claim 2 wherein the pin has a means for adjusting its length.

4. The device of claim 2 wherein the pin is made of a resilient material.

5. The device of claim 2 wherein the pin is made of a metal selected from the group consisting of copper, brass, and stainless steel.

6. The device of claim 5, wherein the inner diameter of the head is sized to retrieve a golf ball.

7. The device of claim 6 wherein the edges of the forward end of the head are beveled.

8. The device of claim 5 wherein the shaft and head are made of PVC.

9. The device of claim 6 wherein the head is separable from the shaft.

10. The device of claim 1 wherein the shaft is comprised of a plurality of telescoping sections.

* * * * *